US008666275B2

(12) United States Patent
Ishizumi et al.

(10) Patent No.: US 8,666,275 B2
(45) Date of Patent: Mar. 4, 2014

(54) IMAGE FORMING APPARATUS

(75) Inventors: Keisuke Ishizumi, Mishima (JP); Tomoo Akizuki, Suntou-gun (JP); Takeshi Shinji, Mishima (JP); Seiji Saito, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 339 days.

(21) Appl. No.: 12/967,236

(22) Filed: Dec. 14, 2010

(65) Prior Publication Data

US 2011/0150524 A1 Jun. 23, 2011

(30) Foreign Application Priority Data

Dec. 18, 2009 (JP) ..... 2009-287815

(51) Int. Cl.
*G03G 15/16* (2006.01)

(52) U.S. Cl.
USPC ..... 399/101

(58) Field of Classification Search
USPC ..... 399/98, 99, 101, 129, 302
See application file for complete search history.

(56) References Cited

U.S. PATENT DOCUMENTS 5,732,310 A * 3/1998 Hiroshima et al. ..... 399/101
5,923,939 A * 7/1999 Koyama ..... 399/308
6,963,716 B2 11/2005 Kobayashi et al.
7,424,254 B2 9/2008 Akizuki et al.
2008/0187369 A1 8/2008 Nakagawa et al.
2009/0232530 A1 9/2009 Saito et al.

FOREIGN PATENT DOCUMENTS

JP 10-49023 A 2/1998
JP 2005-234035 A 9/2005

* cited by examiner

*Primary Examiner* — Walter L Lindsay, Jr.
*Assistant Examiner* — Barnabas Fekete
(74) *Attorney, Agent, or Firm* — Fitzpatrick, Cella, Harper & Scinto

(57) ABSTRACT

An image forming apparatus includes a drum for bearing a toner image; a rotatable belt onto which the toner image is to be transferred from the drum; a primary transfer member for primary transferring the toner image from the drum onto the belt; a secondary transfer member for secondary transferring the toner image from the belt onto a transfer material; and a charging member for electrically charging toner remaining on the belt. The image forming apparatus is capable of executing a belt cleaning mode in which the toner remaining on the belt is electrically charged, and a charging member cleaning mode in which the toner is transferred from the charging member onto the belt and then onto the drum. When the charging member cleaning mode is executed, the charging member is moved at least once from a belt separation position or away from a belt contact position.

21 Claims, 4 Drawing Sheets

IMAGE FORMING APPARATUS

FIELD OF THE INVENTION AND RELATED ART

The present invention relates to an image forming apparatus such as an electrophotographic printer or an electrophotographic copying machine.

As the image forming apparatus such as the electrophotographic printer or copying machine, an image forming apparatus of an intermediary transfer type in which a toner image is formed on an image bearing member and is primary-transferred from the image bearing member onto an intermediary transfer member and then is secondary-transferred from the intermediary transfer member onto a transfer material has been known. In such an image forming apparatus, there is a need to collect transfer residual toner, which has not been secondary-transferred from the intermediary transfer member on the transfer material, from the intermediary transfer member. Japanese Laid-Open Patent Application (JP-A) Hei 10-49023 discloses a constitution, as a residual toner collecting constitution, in which the residual toner is electrically charged by a charging member and the charged residual toner is transferred from the intermediary transfer member to the image bearing member and then is collected on the image bearing member side.

In this constitution, in the case where, e.g., an electroconductive brush, e.g., an electroconductive brush was used as the charging member, a part of the residual toner was deposited on the electroconductive brush and thus a charging performance of the electroconductive brush was lowered in some instances. In the image forming apparatus of the intermediary transfer type, an amount of toner deposited on the charging member was increased with an increasing number of times of image formation. It would be considered that the toner deposited on the charging member is removed by transferring (discharging) the toner from the charging member onto the intermediary transfer member with predetermined timing. However, when the amount of the toner deposited on the charging member is large, there arises a problem that the toner cannot be sufficiently discharged from the charging member on the intermediary transfer member.

SUMMARY OF THE INVENTION

A principal object of the present invention is to provide an image forming apparatus capable of discharging toner efficiently from a charging member even in the case where a large amount of the toner is deposited on the charging member.

According to an aspect of the present invention, there is provided an image forming apparatus comprising:

an image bearing member for bearing a toner image;

a rotatable intermediary transfer member onto which the toner image is to be transferred from the image bearing member;

a primary transfer member for primary-transferring the toner image from the image bearing member onto the intermediary transfer member at a primary transfer portion by being supplied with a voltage;

a secondary transfer member for secondary-transferring the toner image from the intermediary transfer member onto a transfer material at a secondary transfer portion by being supplied with a voltage; and a charging member for electrically charging toner remaining on the intermediary transfer member at a position upstream of the primary transfer portion and downstream of the secondary transfer portion with respect to a rotational direction of the intermediary transfer member, wherein the image forming apparatus is capable of executing an intermediary transfer member cleaning mode in which the toner remaining on the intermediary transfer member is electrically charged by applying a voltage of a predetermined polarity to the charging member in a state in which the charging member is contacted to the intermediary transfer member and then the charged toner is transferred from the intermediary transfer member onto the image bearing member at the primary transfer portion, and is capable of executing a charging member cleaning mode in which the toner is transferred from the charging member onto the intermediary transfer member by applying to the charging member a voltage of an opposite polarity to the predetermined polarity and then the toner transferred from the charging member on the intermediary transfer member is transferred onto the image bearing member at the primary transfer portion, and wherein when the charging member cleaning mode is executed, in a state in which the voltage of the opposite polarity to the predetermined polarity is applied to the charging member, the charging member is moved at least once from a separation position to the intermediary transfer member or moved at least once away from a contact position in which the charging member is contacted to the intermediary transfer member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, embodiments of the present invention will be described specifically. However, dimensions, materials, shapes, relative arrangements, and the like of constituent elements described in the following embodiments may appropriately be changed depending on constitutions to which the present invention is applied and on various conditions.

Embodiment 1

Figure 1:
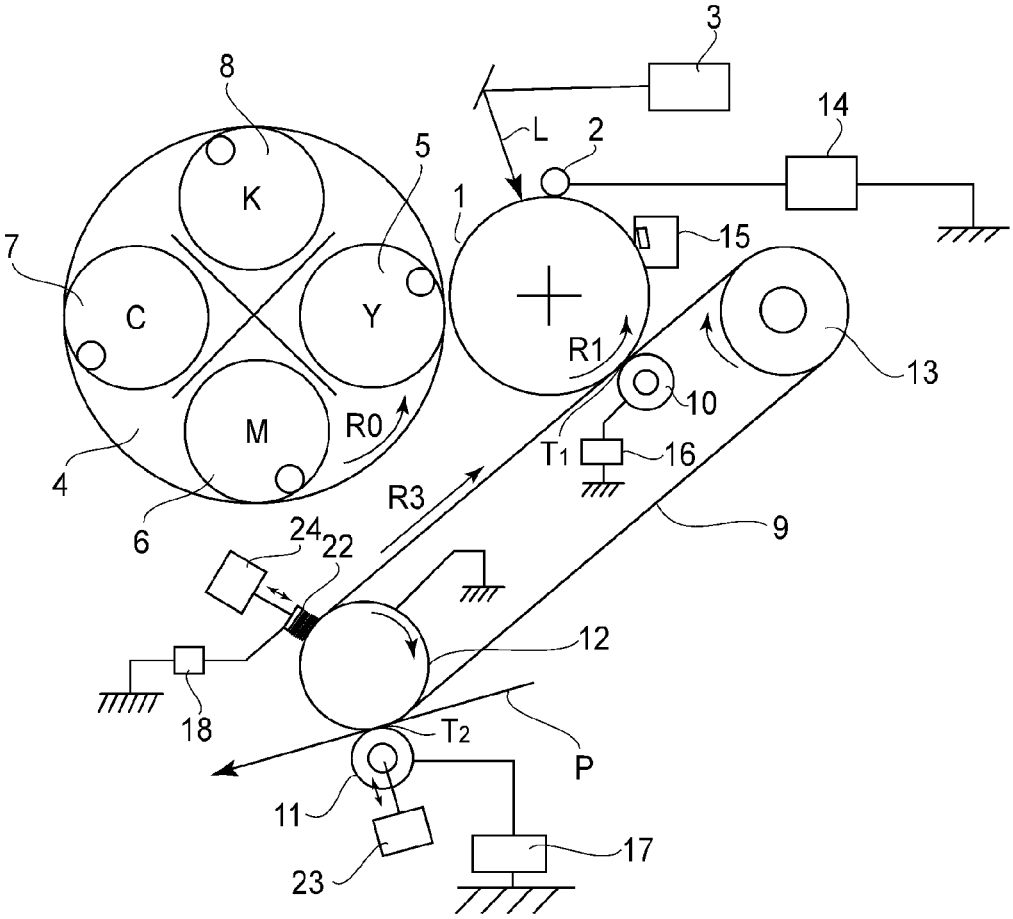
FIG. 1 is a schematic structural view of an example of the image forming apparatus according to the present invention.

FIG. 1 is a schematic sectional view showing an image forming apparatus in this embodiment. In this embodiment, the image forming apparatus is of an electrophotographic type and of an intermediary transfer type, in which toner images of a plurality of colors (e.g., four colors) are successively transferred onto a rotating intermediary transfer member a plurality of times (e.g., four times) and then are collectively transferred from the intermediary transfer member onto a transfer material at a secondary transfer portion. Hereinafter, this type is referred to as a four-path type.

In this embodiment, the image forming apparatus includes a drum-like electrophotographic photosensitive member 1 as an image bearing member (hereinafter referred to as a photosensitive drum 1). Around the photosensitive drum 1, a charging device 2, a rotary 4 including developing devices 5, 6, 7 and 8, an intermediary transfer belt (intermediary transfer member) 9 and a primary transfer roller (primary transfer member) 10 are disposed. Further, adjacently to the intermediary transfer belt 9, a secondary transfer roller (secondary transfer member) 11 and an electroconductive brush (charging member) 22 which are capable of moving toward and away from the intermediary transfer belt 9 are disposed. Therefore, to the secondary transfer roller 11 and the electroconductive brush 22, contact and separation mechanisms 23 and 24, such as an electromagnetic solenoid, for moving the secondary transfer roller 11 and the electroconductive brush 22 toward and away from the intermediary transfer belt 9 are connected, respectively.

The photosensitive drum 1 is driven in a direction indicated by an arrow R1 by a driving means (not shown) and then is uniformly charged to a negative potential by the charging roller connected to a charging bias voltage source 14. The charging roller 2 is a charging member for the photosensitive drum 1. Then, by an exposure device 3, the photosensitive drum 1 is irradiated with laser light L depending on image information, so that a latent image is formed. A single-color toner image of a negative polarity is formed by developing the latent image and then is transferred from the photosensitive drum 1 onto the intermediary transfer belt 9. Here, toner to be used for development has been electrically charged to the negative polarity by triboelectric charge. This negative charge polarity of the toner is a normal charge polarity of the toner. The above steps are repeated on the intermediary transfer belt 9, so that a plurality of single-color toner images are superposed to form multi-color toner images. The multi-color toner images are collectively transferred from the intermediary transfer belt 9 onto a transfer material P.

As the developing devices, in order to visualize the latent images, four developing units 5, 6, 7 and 8 for yellow (Y), magenta (M), cyan (C) and black (K), respectively are provided for the development. The developing units 5, 6, 7 and 8 are supported by the rotary 4. The rotary 4 is rotatable about a shaft (axis). By rotating the rotary 4 in a direction indicated by an arrow R0, the developing units 5, 6, 7 and 8 are successively moved to a developing position in which the latent images are to be developed on the photosensitive drum 1, and then the latent images are developed into the toner images of Y, M, C and K, respectively, in this order.

The intermediary transfer belt 9 is constituted by an endless belt of a resin material and is contacted to the photosensitive drum 1 while being stretched around rollers 12 and 13. The intermediary transfer belt 9 is movable in a direction indicated by an arrow R3 at a peripheral speed substantially equal to that of the photosensitive drum 1 by a driving motor (not shown).

The primary transfer roller 10 as the primary transfer member is disposed at a position (primary transfer portion T1) in which the primary transfer roller 10 opposes the photosensitive drum 1 through the intermediary transfer belt 9. A voltage of a positive polarity (the opposite polarity to the normal charge polarity of the toner) is applied to the primary transfer roller by a transfer voltage source 16, so that the toner image is primary-transferred from the photosensitive drum 1 onto the intermediary transfer belt 9.

Through the above-described steps, the plurality of (four) color toner images of Y, M, C and K are primary-transferred superposedly in this order from the photosensitive drum 1 onto the intermediary transfer belt 9, so that the color toner images are formed on the intermediary transfer belt 9. During periods of the primary transfer of the toner images of Y, M and C, the secondary transfer roller 11 and the electroconductive brush 22 are separated from the intermediary transfer belt 9 so as not to disturb the toner images in contact with the toner images. The secondary transfer roller 11 and the electroconductive brush 22 are contacted to the intermediary transfer belt 9 when the primary transfer of the toner image of K (black) is started, and DC voltages of the positive polarity are applied from power sources 17 and 18 to the secondary transfer roller 11 and the electroconductive brush 22, respectively.

After the secondary transfer roller 11 is contacted to the intermediary transfer belt 9, the transfer material P is fed and conveyed with predetermined timing by a sheet feeding roller and the like to a secondary transfer nip T2 in which the intermediary transfer belt 9 and the secondary transfer roller 11 contact each other. The voltage of the positive polarity is applied to the secondary transfer roller 11 by the transfer bias voltage source 17, so that the multi-color toner images are secondary-transferred from the intermediary transfer belt 9 onto the transfer material P. After the transfer material P passes through the secondary transfer nip T2, the DC voltages applied to the secondary transfer roller 11 and the electroconductive brush 22 are cut off and thereafter the secondary transfer roller 11 and the electroconductive brush 22 are moved away from the intermediary transfer belt 9.

The transfer material P having passed through the secondary transfer nip T2 is conveyed into a fixing device, in which the toner images are fixed and then the transfer material P is conveyed and discharged as an image-formed product (print or copy).

In the case where the image formation is continuously effected, immediately after the completion of the primary transfer of black, a subsequent toner image of yellow is primary-transferred, so that the above-described image forming process is repeated.

The residual toner remaining on the intermediary transfer belt 9 without being secondary-transferred onto the transfer material is charged to the positive polarity (the opposite polarity to the normal charge polarity of the toner) by the electroconductive brush 22 connected to the power source 18. Incidentally, the electroconductive brush 22 slidably contacting the intermediary transfer belt 9 is a brush of nylon fibers which are electroconductive and are 50 μm in fiber diameter.

The residual toner charged to the positive polarity by the electroconductive brush 22 is transferred from the intermediary transfer belt 9 on the photosensitive drum 1 in the primary transfer nip T1 and is finally collected from the photosensitive drum 1 into a cleaning means 15. In this embodiment, an intermediary transfer member cleaning mode is executed, so that the residual toner is collected on the photosensitive drum 1. Incidentally, only the residual toner may be transferred from the intermediary transfer belt 9 on the photosensitive drum 1 at the primary transfer portion by executing the intermediary transfer member cleaning mode. It is also possible to employ a simultaneous transfer and cleaning type in which the intermediary transfer member cleaning mode is executed simultaneously with the image formation and the residual toner is transferred on the photosensitive drum 1 simultaneously with the primary transfer of the subsequent toner image of yellow on the intermediary transfer belt 9.

Almost all of the residual toner is consisting of the negatively charged toner but partly includes the positively charged toner. As described above, the residual toner changed in charge polarity is electrically charged to the positive polarity, so that it is possible to uniformize the charge polarity of the residual toner to the positive polarity. However, when the residual toner is electrically charged by the electroconductive brush 22, almost all of the residual toner of the negative polarity is charged to the positive polarity but the residual toner of the negative polarity which has not been charged to the positive polarity is deposited and remains on the electroconductive brush 22 as it is. An amount of the residual toner deposited on the electroconductive brush 22 is increased with an increasing amount of the residual toner which has reached the electroconductive brush 22 and is continuously increased during continuation of the image formation. For this reason, after a series of image forming operation is completed, there is a need to transfer the toner deposited on the electroconductive brush 22 from the electroconductive brush 22 on the intermediary transfer belt 9. In this embodiment, by executing a charging member cleaning mode, the deposited toner is transferred from the electroconductive brush 22 on the intermediary transfer belt 9. The transfer of the deposited toner from the electroconductive brush 22 on the intermediary transfer belt 9 is referred to as discharge of toner (toner discharge).

The discharge of the toner deposited on the electroconductive brush 22 will be described.

The polarity of the toner deposited on the electroconductive brush 22 is principally negative, and an electric potential on an outer peripheral surface of the intermediary transfer belt 9 is substantially 0 V. For that reason, the toner deposited on the electroconductive brush 22 when the DC voltage of the negative polarity is applied to the electroconductive brush 22 is moved onto the intermediary transfer belt 9 by a potential difference between the intermediary transfer belt 9 and the electroconductive brush 22. However, a part of the deposited toner includes the toner which is negatively charged but has a small charge amount, the toner charged to the positive polarity and the toner having no charge polarity. These toners are not moved from the electroconductive brush 22 on the intermediary transfer belt 9 only by an electrostatic action based on the potential difference provided between the intermediary transfer belt 9 and the electroconductive brush 22 in some cases. Therefore, in this embodiment, after the completion of the image forming process, in order to efficiently discharge the toner from the electroconductive brush 22, a separation operation for moving the electroconductive brush 22 away from the intermediary transfer belt 9 is performed in a state in which the DC voltage of the negative polarity is applied to the electroconductive brush 22, and thereafter a contact operation for moving the electroconductive brush 22 to the intermediary transfer belt 9 is performed in the state of application of the voltage of the negative polarity.

When the contact and separation operations are performed while applying the voltage, a minute space is formed between the electroconductive brush 22 and the intermediary transfer belt 9 immediately before the contact operation or immediately after the separation operation. A negative electric discharge current occurring during the contact and separation operations electrically charges the toner deposited on the electroconductive brush 22 to the negative polarity (identical to that of the voltage applied to the electroconductive brush 22). Specifically, of the toners deposited on the electroconductive brush 22, the toner of the negative polarity is further increased in charge amount and the toner of the positive polarity is inverted into the toner of the negative polarity. Further, the toner having no charge polarity is charged to the negative polarity. As a result, the amount of the toner moved onto the intermediary transfer belt 9 is increased by the electrostatic force based on the potential difference between the intermediary transfer belt 9 and the electroconductive brush 22.

In order to check the discharging method in this embodiment, study on how amount of the toner is discharged when the voltage is applied to the electroconductive brush 22 in a state in which about 50 mg of the toner is deposited on the electroconductive brush 22 in advance was conducted.

Figure 2:
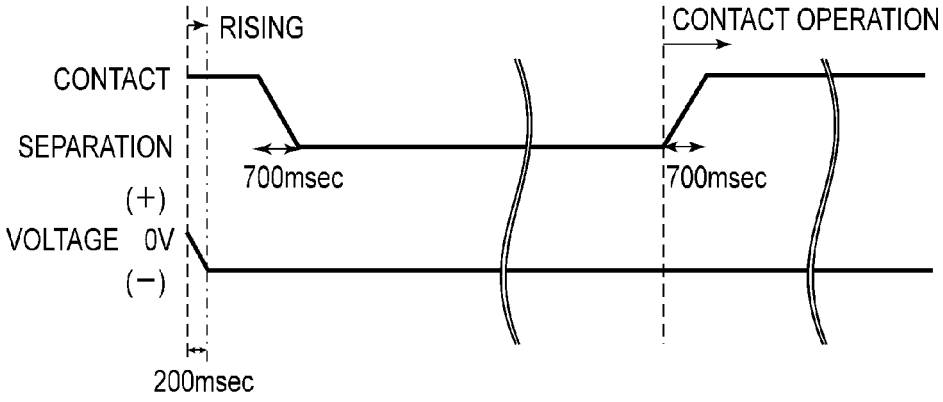
FIG. 2 is a schematic view showing contact and separation of an electroconductive brush and voltage application timing in Embodiment 1.

A voltage of −900 V was applied from a power source 16 to the primary transfer roller 10, so that the photosensitive drum 1 had a surface potential of −500 V. Further, in a state in which each of voltages of −100 V, −400 V, −700 V and −1000 V was applied from the power source 18 to the electroconductive brush 22, the separation operation and the contact operation of the electroconductive brush 22 with respect to the intermediary transfer belt 9 were performed, so that the amount of the toner moved from the electroconductive brush 22 to the intermediary transfer belt 9 at each of the voltages was measured. The voltage application was performed so that the rising was completed when the separation operation of the electroconductive brush 22 was started. The voltage rising required about 200 msec and therefore the voltage application was started earlier than the start of the separation operation by 200 msec or more. Further, the contact operation was performed in the state in which the voltage was applied. Further, the time from the start of the contact operation to the completion of the contact operation is about 700 msec (FIG. 2).

Figure 3:
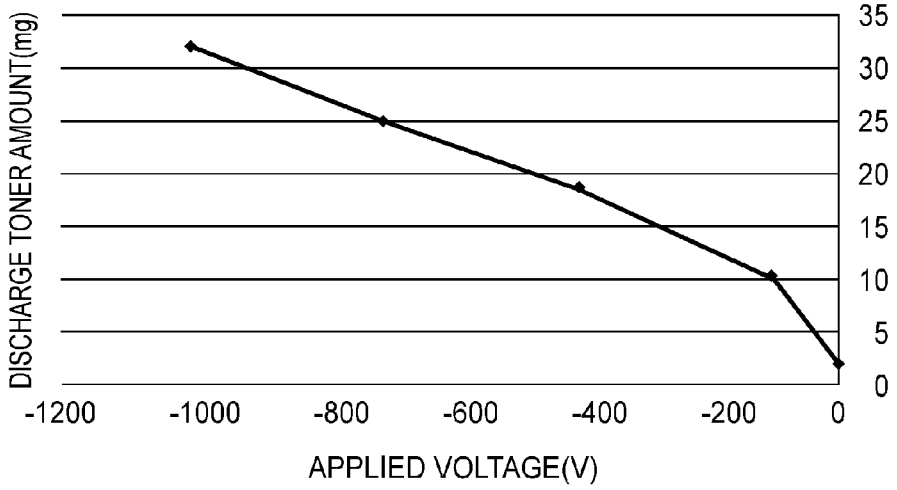
FIG. 3 is a graph showing a relationship between an applied voltage to the electroconductive brush during the contact and separation and a toner discharge amount in Embodiment 1.

FIG. 3 is a result of the study on the discharge toner amount with respect to the voltage applied to the electroconductive brush 22. According to the result of FIG. 3, the amount of the discharged toner is increased with an increasing (absolute) value of the voltage of the negative polarity applied to the electroconductive brush 22. This is because a larger applied voltage provides a large discharge current generated in the gap between the electroconductive brush 22 and the intermediary transfer belt 9 during the contact or separation of the electroconductive brush 22 and thus the toner deposited on the electroconductive brush 22 is liable to be charged to the negative polarity.

In this way, by performing the contact and separation operations in the state in which the voltage is applied to the electroconductive brush 22, the toner can be efficiently discharged from the electroconductive brush 22. Further, the discharged toner is negatively charged and thus is easily collected on the photosensitive drum 1.

Figure 4:
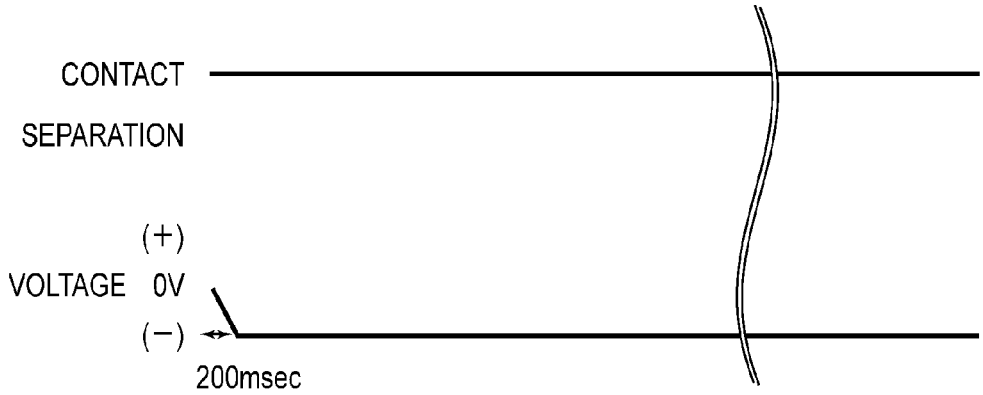
FIG. 4 is a schematic view showing timing of voltage application to an electroconductive brush in Comparative Embodiment.

As Comparative Embodiment, in the state in which the electroconductive brush 22 was contacted to the intermediary transfer belt 9, the voltages were applied to the electroconductive brush 22 and then the amount of the toner discharged from the electroconductive brush 22 was measured (FIG. 4). Specifically, each of the voltages of −100 V, −400 V, −700 V and −1000 V was applied to the electroconductive brush 22 and then the discharge toner amount at each of the voltages was measured.

Figure 5:
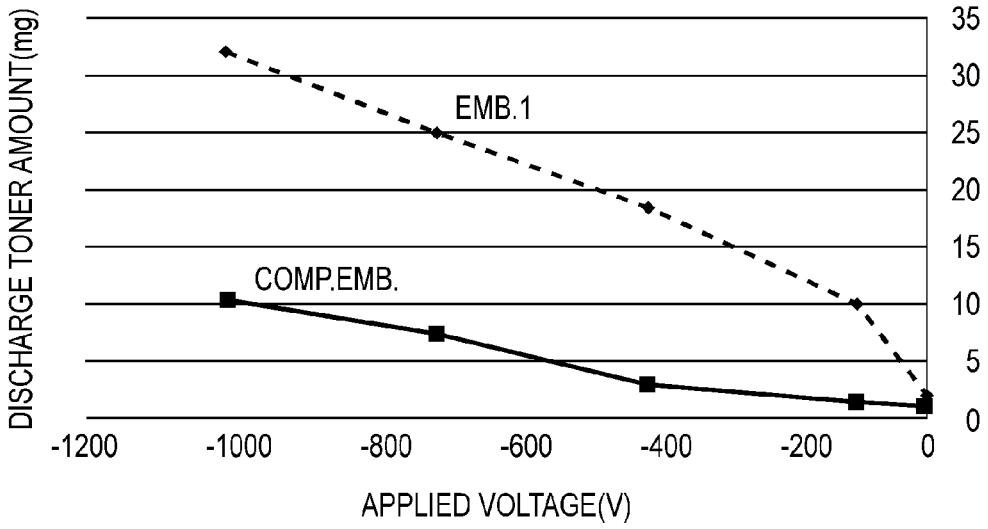
FIG. 5 is a graph showing a relationship between the applied voltage to the electroconductive brush and the toner discharge amount in Embodiment 1 and Comparative Embodiment.

FIG. 5 is a result of study on the discharge toner amount with respect to the voltage applied to the electroconductive brush 22 in Embodiment 1 and Comparative Embodiment. As is apparent from FIG. 5, even at any voltage, it is understood that the discharge toner amount in Embodiment 1 is larger than that in Comparative Embodiment.

In the state in which the electroconductive brush 22 is contacted to the intermediary transfer belt 9, almost all of the current generated by the voltage application directly passes, as an injection current, from the electroconductive brush 22 to the intermediary transfer belt 9. For this reason, in Comparative Embodiment, the amount of the occurrence of the discharge current is small compared with the case where an electric discharge gap is formed as in Embodiment 1. The injection current little passes through the toner and therefore the charge amount of the toner is small, so that the amount of the toner to be discharged is also small. Further, the discharged toner is not so electrically charged, so that a toner collection amount on the photosensitive drum 1 is also decreased.

From the above results of study on the discharge toner amount, when the discharge of the toner deposited on the electroconductive brush 22 is performed by the method in Embodiment 1, the discharge current is generated in a spatial gap formed between the electroconductive brush 22 and the intermediary transfer belt 9 during the contact or separation of the electroconductive brush 22. Then, the charging of the toner is effected. For this reason, according to this embodiment, compared with Comparative Embodiment in which the voltage is applied to the electroconductive brush 22 without performing the contact and separation operations, it becomes possible to efficiently discharge the toner. Further, the discharged toner is electrically charged and thus is easily collected on the photosensitive drum 1.

In the above studies, as the toner charging member, the electroconductive brush 22 having the small fiber diameter was used and therefore the discharge current was liable to occur, so that the effect was obtained even at the applied voltage of −100 V. However, there is a possibility that the discharge current is less liable to occur and thus a sufficient effect cannot be obtained under application of the voltage of −100 V due to factors such as an increase in fiber resistance, an inclination of the fibers, and an increase in resistance of the intermediary transfer belt 9 during continuous image formation. For this reason, the applied voltage may desirably be as large as possible and may desirably be at least an electric discharge threshold voltage defined by Paschen curve. In this embodiment, the electroconductive brush is used as the charging member but it is also possible to use the charging member, other than the electroconductive brush, such as a charging roller.

Embodiment 2

In the case where the image formation is continuously effected (hereinafter referred to as continuous print), the electroconductive brush 22 is contacted to the intermediary transfer belt 9 immediately before the secondary transfer is started. Then, after the contact and before the secondary transfer residual toner passes through the electroconductive brush 22, the DC voltage of the photosensitive drum is applied to the electroconductive brush 22. The residual toner passing through the electroconductive brush 22 is positively charged, thus being transferred onto the photosensitive drum 1. Further, the primary transfer of a subsequent toner image is performed immediately after the primary transfer of the preceding toner image of black, thus being timed to the transfer of the residual toner. A trailing end of the residual toner passes through the electroconductive brush 22 and thereafter the voltage applied to the electroconductive brush 22 is cut off and the electroconductive brush 22 is separated.

The residual toner is positively charged by the electroconductive brush 22 but partly includes toner which is not electrically charged. These toners are deposited on the electroconductive brush 22, so that a larger amount of the toners are deposited on the electroconductive brush 22 with an increasing print number.

Figure 6:
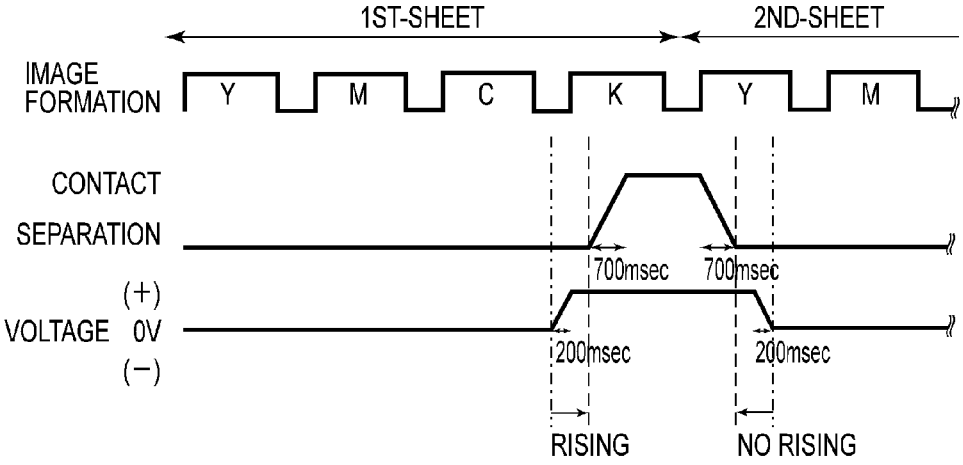
FIG. 6 is a schematic view showing contact and separation of an electroconductive brush and voltage application timing in Embodiment 2.

In this embodiment, the following operation was performed in order to discharge the toner deposited on the electroconductive brush 22 every sheet and to collect the discharged toner on the photosensitive drum 1 without lowering a print speed during the continuous print. The contact and separation operations of the electroconductive brush 22 were performed every sheet while applying the voltage of +1000 V during the continuous print (FIG. 6). The constitution of the image forming apparatus in this embodiment is similar to that in Embodiment 1.

Almost all of the toner deposited on the electroconductive brush 22 has the negative polarity but the toner of the positive polarity is partly present and therefore these toners are discharged by applying the voltage of the positive polarity to the electroconductive brush 22. Further, the discharge current generated when the electroconductive brush 22 is moved toward and away from the intermediary transfer belt 9 passes through the toner deposited on the electroconductive brush 22, so that the toners deposited on the electroconductive brush 22 are positively charged and thus are also discharged. During the continuous print, the voltage of the positive polarity is applied as the primary transfer voltage and therefore the discharged toner is immediately transferred back onto the photosensitive drum 1.

As described above, the contact and separation operations are performed by the method in this embodiment, so that the toner deposited on the electroconductive brush 22 during the continuous print can be discharged and the discharged toner can be transferred back onto the photosensitive drum 1 immediately.

Embodiment 3

In this embodiment, the amount of the toner discharged from the electroconductive brush 22 is adjusted. In the case of the four-pass type image forming apparatus, only one photosensitive drum collects the toner discharged from the electroconductive brush 22. When a large amount of the discharged toner reaches the primary transfer portion at one time, there is a possibility that the toner transferred from the intermediary transfer belt 9 to the photosensitive drum 1 is not completely collected by a cleaning means 15 opposing the photosensitive drum 1 at the primary transfer portion.

Further, in the case where the toner on the photosensitive drum 1 is not completely collected by the cleaning means 15, the toner can be deposited on the charging roller 2. When the toner is deposited on the charging roller 2, the charging of the surface of the photosensitive drum 1 is insufficient at the toner deposition portion and thus leads to an occurrence of image defect corresponding to the toner deposition portion.

In order to suppress the occurrence of such a problem, there is a need to adjust the toner discharge amount from the electroconductive brush 22.

In this embodiment, the voltages of the negative polarity and the positive polarity were alternately applied to the electroconductive brush 22 in the state in which the electroconductive brush 22 was contacted to the intermediary transfer belt 9, so that the toner was discharged from the electroconductive brush 22. The constitution of the image forming apparatus in this embodiment is similar to that in Embodiment 1.

Figure 7:
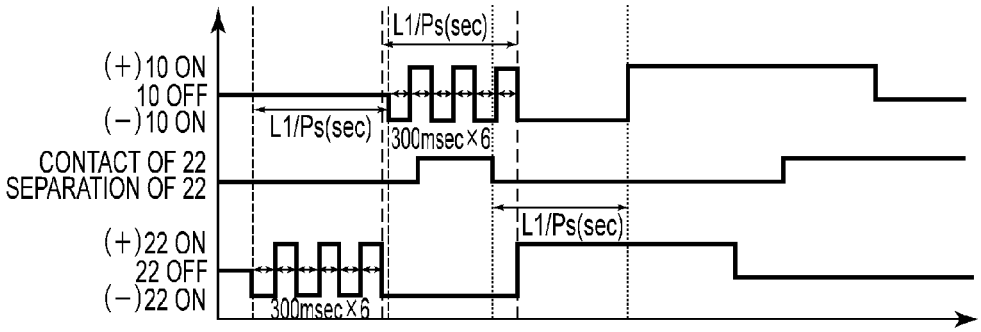
FIG. 7 is a schematic view showing timing of voltage application to an electroconductive brush in Embodiment 3.

FIG. 7 is a series of sequence of the toner discharging step in this embodiment. In the toner discharging step in this embodiment, after the completion of the series of image forming operations, the voltages of the negative polarity and the positive polarity were alternately applied to the electroconductive brush 22 three times in the state in which the electroconductive brush 22 was contacted to the intermediary transfer belt 9, so that the toner was discharged. Thereafter, in a state in which the voltage of the negative polarity is applied to the electroconductive brush 22, the electroconductive brush 22 is moved away from the intermediary transfer belt 9 and then is moved to contact the intermediary transfer belt 9.

After the separating and contacting of the electroconductive brush 22, the voltages of the positive polarity are applied to the electroconductive brush 22 and the primary transfer roller 10 and thus the discharge toner remaining on the intermediary transfer belt 9 is charged to the positive polarity, so that the toner is collected on the photosensitive drum 1. The amount of the toner discharged from the electroconductive brush 22 when the voltage is applied is maximum at the instance when the voltage is applied, so that the toner discharge amount is saturated in a time of about 250 msec. In the step for alternately applying the voltages of the negative polarity and the positive polarity to the electroconductive brush 22, each of the respective voltages was alternately applied for 300 msec with allowance. When a distance from the electroconductive brush 22 to the primary transfer position is L1 and a rotational speed of the intermediary transfer belt 9 is Ps, the toners including the toners of the negative polarity and the positive polarity which are alternately discharged from the electroconductive brush 22 reach the primary transfer position after a laps of L1/Ps sec immediately after the toners are discharged from the electroconductive brush 22. For this reason, the polarity of the voltage to be applied to the primary transfer roller 10 after the lapse of L1/Ps sec from the instance when the first voltage of the negative polarity is applied to the electroconductive brush 22 is negative. Similarly, the polarity of the voltage to be applied to the primary transfer roller 10 after the lapse of L1/Ps sec from the instance when the voltage of the positive polarity is applied to the electroconductive brush 22 is positive.

Thus, in this embodiment, the electroconductive brush 22 is moved toward and away from the intermediary transfer belt 9 with timing after the voltages of the negative polarity and the positive polarity are alternately applied to the electroconductive brush 22. Specifically, in the state in which the voltage of the negative polarity was applied to the electroconductive brush 22, the separating and contacting operations were performed. In this case, the polarity of the toner discharged from the electroconductive brush 22 is negative and therefore the voltage of the negative polarity is applied to the primary transfer roller 10 in order to collect the discharged toner. The application of the negative polarity voltage to the primary transfer roller 10 is continued until the toner discharged when the electroconductive brush 22 is contacted to the intermediary transfer belt 9 reaches the primary transfer portion. Thereafter, the voltage of the positive polarity was applied also to the primary transfer roller 10, so that the residual toner charged to the positive polarity on the intermediary transfer belt 9 by the electroconductive brush 22 was collected on the photosensitive drum 1. The collection of the residual toner was performed by one full circumference of the rotation of the intermediary transfer belt 9 and then the electroconductive brush 22 was moved away from the intermediary transfer belt 9, so that the discharging operation was completed.

As described above, in this embodiment, after a certain amount of the toner was discharged from the electroconductive brush 22 in advance, the electroconductive brush 22 was moved toward and away from the intermediary transfer belt 9, so that it was possible to sufficiently discharge the toner from the electroconductive brush 22 while suppressing collection failure of the discharged toner.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 287815/2009 filed Dec. 18, 2009, which is hereby incorporated by reference.

What is claimed is:

1. An image forming apparatus comprising:

an image bearing member for bearing a toner image;

a rotatable intermediary transfer member onto which the toner image is to be transferred from said image bearing member;

a power source; and a charging member for electrically charging a toner remaining on said intermediary transfer member by being supplied with a voltage of a predetermined polarity from said power source, wherein said charging member is capable of being moved toward and away from said intermediary transfer member, wherein said image forming apparatus is capable of executing an operation in a charging member cleaning mode in which the toner is transferred from said charging member onto said intermediary transfer member by applying a voltage of an opposite polarity to the predetermined polarity from said power source to said charging member, and wherein upon execution of the operation in the charging member cleaning mode, the voltage of the opposite polarity to the predetermined polarity is applied to said charging member, and then said charging member is moved, while maintaining the application of the voltage of the opposite polarity, at least once away from a contact position in which said charging member is contacted to said intermediary transfer member.

2. An apparatus according to claim 1, wherein said charging member is, while maintaining the application of the voltage of the opposite polarity, moved from the contact position to a separation position, and then said charging member is moved from the separation position to the contact position while maintaining the application of the voltage of the opposite polarity.

3. An apparatus according to claim 1, wherein said charging member is a brush member.

4. An apparatus according to claim 1, wherein when image forming operations are performed on continuously conveyed transfer materials, said charging member electrically charges the toner, remaining on said intermediary transfer member, generated with every conveyed transfer material and thereafter said charging member is, while maintaining the application of the voltage of the opposite polarity, moved from the contact position to the separation position, and then said charging member is moved from the separation position to the contact position while maintaining the application of the voltage of the opposite polarity.

5. An apparatus according to claim 1, wherein said charging member is moved from the contact position to form a space between said intermediary transfer member and said charging member, and wherein the toner deposited on said charging member is electrically charged by electric discharge generated in the space.

6. An apparatus according to claim 1, wherein said power source applies a DC voltage to said charging member.

7. An apparatus according to claim 1, wherein said image forming apparatus is capable of executing an operation in an intermediary transfer member cleaning mode in which the toner remaining on said intermediary transfer member is electrically charged by applying a voltage of the predetermined polarity to said charging member in a state in which said charging member is contacted to said intermediary transfer member and then the charged toner is transferred from said intermediary transfer member onto said image bearing member.

8. An apparatus according to claim 1, further comprising:

a primary transfer member for primary-transferring the toner image from said image bearing member onto said intermediary transfer member at a primary transfer portion; and a secondary transfer member for secondary-transferring the toner image from said intermediary transfer member onto a transfer material at a secondary transfer portion.

9. An image forming apparatus comprising:

an image bearing member for bearing a toner image;

a rotatable intermediary transfer member onto which the toner image is to be transferred from said image bearing member;

a power source; and a charging member for electrically charging a toner remaining on said intermediary transfer member by being supplied with a voltage of a predetermined polarity from said power source, wherein said charging member is capable of being moved toward and away from said intermediary transfer member, wherein said image forming apparatus is capable of executing an operation in a charging member cleaning mode in which the toner is transferred from said charging member onto said intermediary transfer member by applying a voltage of an opposite polarity to the predetermined polarity from said power source to said charging member, and wherein upon execution of an operation in the charging member cleaning mode, the voltage of the opposite polarity to the predetermined polarity is applied to said charging member, and then said charging member is moved from a separation position toward a contact position in which said charging member is contacted to said intermediary transfer member while maintaining the application of the voltage of the opposite polarity.

10. An apparatus according to claim 9, wherein said charging member is a brush member.

11. An apparatus according to claim 9, wherein said power source applies a DC voltage to said charging member.

12. An apparatus according to claim 9, wherein said image forming apparatus is capable of executing an intermediary transfer member cleaning mode in which the toner remaining on said intermediary transfer member is electrically charged by applying a voltage of the predetermined polarity to said charging member in a state in which said charging member is contacted to said intermediary transfer member and then the charged toner is transferred from said intermediary transfer member onto said image bearing member.

13. An image forming apparatus comprising:

an image bearing member for bearing a toner image;

a rotatable intermediary transfer member onto which the toner image is to be transferred from said image bearing member;

a power source; and a charging member for electrically charging a toner remaining on said intermediary transfer member by being supplied with a voltage of a predetermined polarity from said power source, wherein said charging member is capable of being moved toward and away from said intermediary transfer member, wherein said image forming apparatus is capable of executing an operation in a charging member cleaning mode in which the toner is transferred from said charging member onto said intermediary transfer member by applying a voltage of an opposite polarity to the predetermined polarity from said power source to said charging member, and wherein upon execution of an operation in the charging member cleaning mode, when a space is formed between said charging member and said intermediary transfer member, the toner deposited on said charging member is electrically charged by electric discharge generated by applying the voltage of the opposite polarity from said power source to said charging member.

14. An apparatus according to claim 13, wherein said charging member is a brush member.

15. An apparatus according to claim 13, wherein said power source applies a DC voltage to said charging member.

16. An apparatus according to claim 13, wherein said image forming apparatus is capable of executing an intermediary transfer member cleaning mode in which the toner remaining on said intermediary transfer member is electrically charged by applying a voltage of the predetermined polarity to said charging member in a state in which said charging member is contacted to said intermediary transfer member and then the charged toner is transferred from said intermediary transfer member onto said image bearing member.

17. An image forming apparatus comprising:

an image bearing member for bearing a toner image;

a rotatable intermediary transfer member onto which the toner image is to be transferred from said image bearing member;

a power source; and a charging member for electrically charging a toner remaining on said intermediary transfer member by being supplied with a voltage of a predetermined polarity from said power source, wherein said charging member is capable of being moved toward and away from said intermediary transfer member, wherein said image forming apparatus is capable of executing an operation in a charging member cleaning mode in which the toner is transferred from said charging member onto said intermediary transfer member by applying a voltage of an opposite polarity to the predetermined polarity from said power source to said charging member, and wherein in the operation in the charging member cleaning mode, while maintaining at least a state in which the voltage of the opposite polarity is applied to said charging member, said charging member is moved so as to be contacted to said intermediary transfer member or moved so as to be away from said intermediary transfer member.

18. An apparatus according to claim 17, wherein said charging member is a brush member.

19. An apparatus according to claim 17, wherein said power source applies a DC voltage to said charging member.

20. An apparatus according to claim 17, wherein when the operation in a charging member cleaning mode is executed in a state in which said charging member is contacted to said intermediary transfer member, said charging member is spaced from said intermediary transfer member first and then is contacted to said intermediary transfer member.

21. An apparatus according to claim 17, wherein said image forming apparatus is capable of executing an operation in an intermediary transfer member cleaning mode in which the toner remaining on said intermediary transfer member is electrically charged by applying a voltage of the predetermined polarity to said charging member in a state in which said charging member is contacted to said intermediary transfer member and then the charged toner is transferred from said intermediary transfer member onto said image bearing member.

* * * * *